US011185877B2

(12) United States Patent
Goettke et al.

(10) Patent No.: US 11,185,877 B2
(45) Date of Patent: Nov. 30, 2021

(54) DISPENSER FOR DISPENSING LIQUID OR PASTY MATERIALS

(71) Applicant: RPC Bramlage GmbH, Lohne (DE)

(72) Inventors: Sabine Goettke, Lohne (DE); Martin Presche, Dinklage (DE)

(73) Assignee: RPC Bramlage GmbH, Lohne (DE)

( * ) Notice: Subject to any disclaimer, the term of this patent is extended or adjusted under 35 U.S.C. 154(b) by 0 days.

(21) Appl. No.: 16/755,203

(22) PCT Filed: Oct. 11, 2018

(86) PCT No.: PCT/EP2018/077671
§ 371 (c)(1),
(2) Date: Apr. 10, 2020

(87) PCT Pub. No.: WO2019/072945
PCT Pub. Date: Apr. 18, 2019

(65) Prior Publication Data

US 2021/0220854 A1 Jul. 22, 2021

(30) Foreign Application Priority Data

Oct. 12, 2017 (GB) ..... 1716675

(51) Int. Cl.
*B05B 11/00* (2006.01)

(52) U.S. Cl.
CPC ..... *B05B 11/0075* (2013.01); *B05B 11/007* (2013.01); *B05B 11/0032* (2013.01); *B05B 11/0067* (2013.01); *B05B 11/0072* (2013.01); *B05B 11/00416* (2018.08); *B05B 11/3047* (2013.01); *B05B 11/3061* (2013.01); *B05B 11/3069* (2013.01); *B05B 11/3074* (2013.01)

(58) Field of Classification Search
CPC ..... B05B 11/0075; B05B 11/3069; B05B 11/0072; B05B 11/0032; B05B 11/0067; B05B 11/00416; B05B 11/3074; B05B 11/3061; B05B 11/3047; B05B 11/007
USPC ... 222/202.13, 321.6–321.9, 321.3, 532, 536
See application file for complete search history.

(56) References Cited

U.S. PATENT DOCUMENTS 2,730,274 A 1/1956 Brown
3,088,636 A * 5/1963 Spatz ..... G01F 11/003 222/213

(Continued)

FOREIGN PATENT DOCUMENTS

EP 2 305 577 A1 4/2011
FR 2997873 A1 * 11/2012

(Continued)

OTHER PUBLICATIONS

International Search Report of PCT/EP2018/077671, dated Jan. 30, 2019.

*Primary Examiner* — Lien M Ngo
(74) *Attorney, Agent, or Firm* — Collard & Roe, P.C.

(57) ABSTRACT

A dispenser for dispensing liquid or pasty materials has a head part with a dispenser opening. The dispenser opening is formed by lip sections which lie directly on top of each other. A lip section for opening the dispenser opening can be lifted from the other lip section by means of a lifting part that engages on the lip section. The lifting part acts on the lip section with a loading direction that runs transversely to a dispensing direction of the material.

4 Claims, 4 Drawing Sheets

(56) References Cited

U.S. PATENT DOCUMENTS

| | | | | | |
|---|---|---|---|---|---|
| 4,978,037 | A * | 12/1990 | Schuckmann | B65D 83/0033 | 222/260 |
| 5,320,291 | A * | 6/1994 | Glover | B05B 11/3097 | 239/708 |
| 5,360,145 | A * | 11/1994 | Gueret | B05B 11/0005 | 222/190 |
| 2004/0065689 | A1 * | 4/2004 | Pritchett | B05B 11/3074 | 222/321.7 |
| 2008/0251542 | A1 * | 10/2008 | Rossignol | B05B 11/3074 | 222/380 |
| 2012/0111896 | A1 * | 5/2012 | Lee | B05B 11/0029 | 222/321.3 |

FOREIGN PATENT DOCUMENTS

| | | | |
|---|---|---|---|
| WO | 99/62785 | A1 | 12/1999 |
| WO | 2010/038014 | A1 | 4/2010 |

* cited by examiner

DISPENSER FOR DISPENSING LIQUID OR PASTY MATERIALS

CROSS REFERENCE TO RELATED APPLICATIONS

This application is the National Stage of PCT/EP2018/077671 filed on Oct. 11, 2018, which claims priority under 35 U.S.C. § 119 of British Application No. 1716675.2 filed on Oct. 12, 2017, the disclosure of which is incorporated by reference. The international application under PCT article 21(2) was not published in English.

TECHNICAL FIELD

The invention pertains to a dispenser for dispensing liquid or pasty materials, which comprises a head part that has a dispensing opening, wherein the dispensing opening is formed by lip sections that lie directly on top of one another.

PRIOR ART

Dispensers of the type in question are known in different designs. The material to be dispensed is usually output through the dispensing opening during a dispenser actuation. In this respect, it is known to form such a dispensing openings by lip sections that lie directly on top of one another, particularly flatly on top of one another. To this end, the lip sections may consist of an elastically deformable material, which due to the pressure of the material during a material output makes it possible to displace at least one lip section against the restoring forces being built up in order to thereby open the dispensing opening. Due to this elastic design, the at least one lip section retracts into the closed position of the opening as the pressure of the material decreases or ceases.

SUMMARY OF THE INVENTION

Based on the above-described the prior art, the invention aims to advantageously enhance a dispenser of the type in question, particularly with respect to the lip closure.

According to a first inventive idea, this objective is potentially attained with a dispenser, in which it is proposed that a lip section can be lifted off the other lip section by means of a lifting part engaging on the lip section in order to open the dispensing opening, wherein the lifting part acts upon the lip section with a loading direction that extends transverse to a dispensing direction of the material.

As a result of the proposed design, the lifting part respectively makes it possible to actively displace the at least one lip section into the open position of the dispensing opening or to actively assist in the displacement of the lip section into the open position of the dispensing opening. In this way, the lip section can be actively displaced from the closed position into the open position, as well as optionally, but also additionally, actively retracted from the open position into the closed position of the dispensing opening.

The lip section or lip sections may consist of a material that allows the desired tightness when the lip sections directly adjoin one another. As a result of the proposed design, elastic properties, which are required for also ensuring a reliable opening and particularly closing motion of one or both lip sections over a prolonged period of use of the dispenser with correspondingly frequent actuation of one or both lip sections, are not absolutely necessary, but by all means possible for assisting in the active displacement by means of the lifting part and optionally for forming a sealing closure.

In this case, the lifting part may act upon the lip section with a loading direction that is oriented transverse to the dispensing direction of the material. According to a preferred embodiment, the loading direction of the lifting part may therefore essentially correspond to an actuating direction of the dispenser or be oriented in this actuating direction.

Other characteristics of the invention are frequently described below, as well as in the description of the figures, in their preferred association with the object of claim 1 or with characteristics of other claims. However, they may also be important in association with only individual characteristics of claim 1 or the respective other claim or independently.

According to a potential embodiment, the lifting part may be movable for opening the dispensing opening due to a material pressure that is built up in the dispenser in the course of an output of material. Accordingly, the active displacement or the active assistance in the displacement of the one lip section by the lifting part may be dependent on a buildup of material pressure in the course of the actuation of the dispenser. The material being conveyed in the direction of the dispensing opening in the dispenser may serve for opening the dispensing opening indirectly, but optionally also directly, in that the lifting part is indirectly or directly acted upon for carrying out the corresponding displacement by the material pressure being built up in the course of the dispensing process.

When the reservoir of the dispenser is empty, this may result in the additional advantageous effect that the lip section coupled to the lifting part is according to a preferred embodiment not lifted during a conventional dispenser actuation for outputting material due to the respectively lacking or insufficient material pressure. Accordingly, the dispensing opening is not opened in this case. The dispenser opening therefore can also remain closed during a dispenser actuation when the reservoir of the dispenser is empty.

According to a potential embodiment, the material pressure may directly act upon the lifting part. In this case, it is proposed that the material pressure preferably acts upon a lever part that moves the lifting part. The lever part may serve for the directional control of the lifting part, wherein the lever part may in a potential embodiment be respectively supported in the dispenser or in the head part of the dispenser, e.g. in a pivotable manner. A corresponding geometric pivoting axis may in this case be oriented transverse to the loading direction of the lifting part.

According to a potential embodiment, the lever part may form part of the lifting part and be realized integrally with the lifting part. In this respect, the lifting part and the lever part may therefore be realized integrally and optionally consist of the same material. For example, this combination may be realized in the form of a plastic part such as an injection molded plastic part.

In another embodiment, the dispenser may have an elastically deformable section. This elastically deformable section may be acted upon as a result of the material pressure being built up in the dispenser during an output of material.

Furthermore, such an elastically deformable section may release a transfer channel section for the material from a dispensing channel on the dispenser side in the direction of a dispensing opening channel leading to the dispensing opening as a result of the material pressure being built up during an output of material. In the non-actuated normal position of the dispenser, in which the dispensing opening is also closed by the lip sections lying on top of one another, the elastically deformable section may block this transfer channel section completely or optionally only partially or reduce the corresponding channel cross section transverse to a flow direction of the material through this channel section.

Furthermore, the elastically deformable section preferably may be deformable by the material pressure in order to act upon the lever part. Accordingly, the material pressure may indirectly act upon the lever part. The elastic section preferably can be purposefully deformed in the direction of the lever part as the material pressure is built up or increases. In this case, the elastically deformable section may furthermore have a sealing effect in that a material channel section covered by the elastically deformable section, e.g. the above-described transfer channel section and optionally regions of the dispensing channel and the dispensing opening channel leading into this channel section, are sealed toward the outside, particularly in the direction of the lever part.

The lever part that can be displaced by this section may pivot, for example, about a geometric pivoting axis and correspondingly carry along the lifting part as a result of an elastic deformation of this section at a corresponding material pressure.

A retraction of the lever part with its lifting part may be realized actively by means of the elastically restorable section, e.g. as a result of a corresponding connection of the elastically deformable section to the lever part. The lever part may also have elastically restorable properties in order to carry out the return pivoting motion such that the lever part can automatically pivot back into the normal position when the material pressure ceases and the elastically deformable section is correspondingly retracted into its normal position, wherein the lifting part that is arranged on the lever part, e.g. in a rigid manner, can thereby displace the lip section into the closed position of the dispensing opening.

A lingering pressure may continue to act in the conveying channel of the material, particularly also in the dispensing opening channel leading to the dispensing opening, due to the elastically deformable section, but optionally also due to an (additional) flexible design of the lever part, when the material pressure ceases upon a corresponding release of the head part of the dispenser for the retraction thereof such that the dispensing opening being returned into the closed position does not allow a backflow of material opposite to the dispensing direction in the course of the retraction until the completely closed position is reached.

BRIEF DESCRIPTION OF THE DRAWINGS

The invention is described in greater detail below with reference to the attached drawings that merely show an exemplary embodiment. In these drawings.

DESCRIPTION OF THE EMBODIMENTS

A dispenser 1 for the arrangement on a reservoir 2 is initially described with reference to FIG. 1.

According to the exemplary embodiment shown, the reservoir 2 may be realized in the form of an essentially cylindrical body with a central longitudinal axis x, which in the correspondingly associated position may also extend through the dispenser 1, preferably in the form of a rotational axis.

The reservoir 2 has a storage chamber 3 for accommodating a material M to be dispensed. This storage chamber 3 may be bounded on its bottom side by a follower piston 4.

Figure 1:
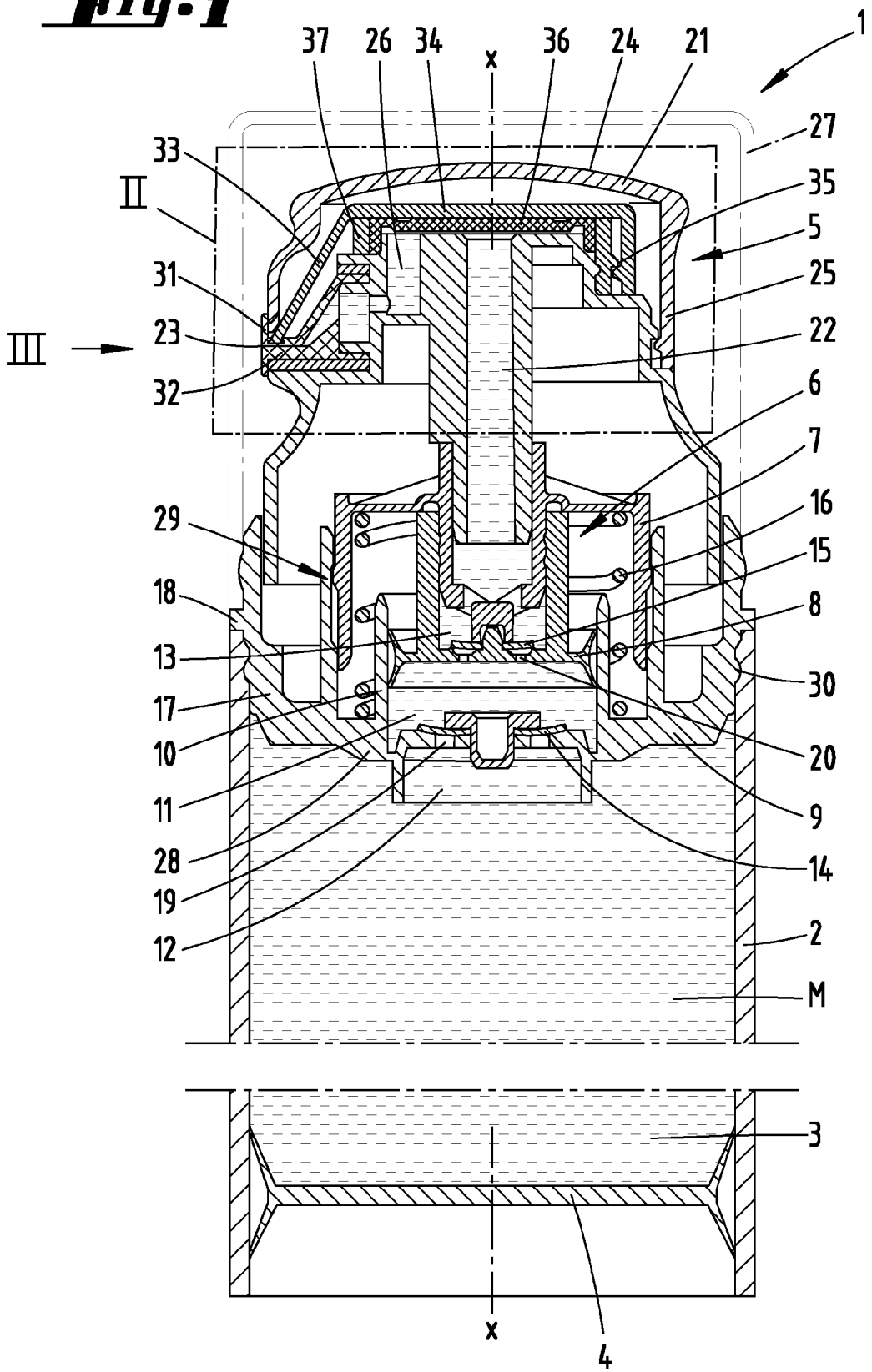
FIG. 1 shows a longitudinal section through a dispenser of the type in question concerning a non-actuated normal position of the dispenser.

The dispenser 1 can be inserted into the opening of the reservoir 2, which points upward in the normal upright position of the reservoir 2 according to FIG. 1, and fastened on the reservoir 2.

The dispenser 1 may be essentially composed of a head part 5 and a dispenser pump 6.

The dispenser pump 6 may first of all comprise a piston body 7 with a piston 8 and a pot part 9 with a pot bottom 28, as well as a cylinder section 10. In this case, the piston 8 may be accommodated in the cylinder section 10 so as to be movable along the longitudinal axis x in a sliding manner, wherein a pump chamber 11 may be formed between the piston 8 and the cylinder section 10 and additionally bounded by the pot bottom 28 of the pot part 9.

The pot part 9 may be realized in an exchangeable manner in order to be adapted to different reservoirs 2, particularly different opening diameters and/or opening cross sections of the reservoir 2.

The pump chamber 11 can connect an input channel 12 and an output channel 13, wherein both channels can be respectively separated from the pump chamber 11 by means of a valve 14 on the input side and a valve 15 on the output side.

The two valves 14 and 15 are realized in the form of check valves and preferably installed such that they open in the same direction, i.e. in the dispensing direction.

A retraction device 16, which is realized in the form of a cylindrical spring in the embodiment shown, may be arranged between the piston body 7 and the cylinder section 10.

Furthermore, the retraction device 16 preferably is arranged concentric to the longitudinal axis x such that one of its ends can be supported on the pot bottom 28 and its other end can act against an end wall of the piston body 7, namely in such a way that the head part 5 with the piston body 7 and the piston 8 is loaded in the direction of an enlargement of the pump chamber in order to once again fill the pump chamber 11 after a pump stroke, during which the pump chamber volume is reduced.

The piston body 7 and the pot part 9 may be respectively realized in an essentially pot-shaped manner. They may be engaged with one another and jointly bound the dispenser pump 6 toward the outside such that a capsule-like housing is formed. At least one fastening projection 18, which may also be realized, for example, in the form of an annular projection, may be formed on an optionally radial pot wall 17 of the pot part 9. This fastening projection 18 may serve for fixing the position of the dispenser pump 6 in the installed state between the head part 5 and the reservoir 2.

According to the exemplary embodiment shown, the valves 14 and 15 may furthermore be realized in the form of so-called annular gap valves with an annular valve body that respectively covers annular gaps 19 and 20 of the input channel 12 and the output channel 13.

A homogenous dispensing behavior is achieved due to a radially symmetrical design of the dispenser pump 6. However, the dispenser pump is not limited to radially symmetrical variations, but may also have any cross-sectional shape, e.g. a square or polygonal cross-sectional shape. Other known check valves such as flap valves may also be used instead of the annular gap valves shown.

The piston 8 may furthermore be realized integrally with the piston part 7. A kinematic reversal of the dispenser pump 6 with a reversed opening direction of the check valves is also possible.

The head part 5 may be connected to the dispenser pump 3, wherein said head part comprises a dome-like actuating part 21 with a dispensing channel 22 and a dispensing opening 23, as well as an actuating surface 24 that is formed on its upper side and preferably oriented transverse to the longitudinal axis x and a partial actuating wall 25 that optionally extends circumferentially concentric to the longitudinal axis x.

On the outer side of the wall, the partial actuating wall 25 of the actuating part 21 preferably is circumferentially guided in the axial direction by the pot wall 17 of the pot part 9.

The dispensing channel 22, which in the exemplary embodiment shown initially accommodates the longitudinal axis x centrally along its longitudinal extent, may essentially extend radially outward into a dispensing opening channel 26 referred to a cross-sectional view, in which the longitudinal axis x is illustrated in the form of a line, e.g. according to FIG. 1. In this case, the dispensing channel 22 may be inserted into the output channel 13 in a sealing manner, wherein the piston 8, the piston body 7 and the dispensing channel 22 including the actuating part 21 furthermore can interact in the usage position for the common displacement along the longitudinal axis x. Accordingly, the entire head part 5 with the piston 8 fixed thereon may be supported by means of the retraction device 16.

When the dispenser pump 6 or the dispenser 1 as a whole is inserted into the reservoir 2, a lower edge of the dispenser pump 6 with its input channel 12 penetrates into the reservoir 2 and therefore into the material M stored therein to such an extent that it may come in direct contact with the material M to be dispensed. During the attachment of the dispenser 1 to the reservoir 2, the material M therefore can preferably spread out as far as into the pump chamber 11 for the initial filling thereof through the input valve 14, which opens as a result of the pressurization occurring in the course of the attachment.

The illustration in FIG. 1 furthermore shows that the dispenser 1, particularly the head part 5, may be covered with a cap 27 in the non-usage position. In this case, this cap can be fixed in the region of the pot wall 17, e.g. by means of a snap-on mechanism, while it is optionally and preferably axially supported on the fastening projection 18.

In addition, a limiting device 29 may be provided for limiting the axial displaceability of the head part 5 including the piston 8, particularly into a distant position referred to the pot part 9. The exemplary limiting position illustrated in FIG. 1 represents a maximum filling position of the pump chamber 11.

The dispenser pump 6 may be fixed on the reservoir 2 by means of a snap-on connection. 30. This connection may be produced in a region that essentially lies directly underneath the fastening projection 18 of the pot part 9, which is supported on the wall of the reservoir 2.

The dispensing opening 23 preferably is formed by two lip sections 31 and 32 that in the closed state lie directly on top of one another, particularly flatly on top of one another. Accordingly, a so-called lip closure may be realized in the dispensing opening 23.

Both lip sections 31 and 32 that form the lip closure are preferably anchored in the head part 5, e.g. as a result of injection molding the plastic material that essentially forms the head part 5 around one end of the lip sections.

For example, the lower lip section 32 in the normal upright position may be fastened on the head part 5 in an immovable or essentially immovable manner as shown whereas the upper lip section 31 in the normal upright position is only connected to the head part 5 on one end such that the lip section 31 can carry out a motion in a direction extending transverse to a dispensing direction r of the material M, particularly in the dispensing opening channel 26.

The lip sections 31 and 32 may consist of an elastic material such as an elastomeric material or rubber.

Figure 2:
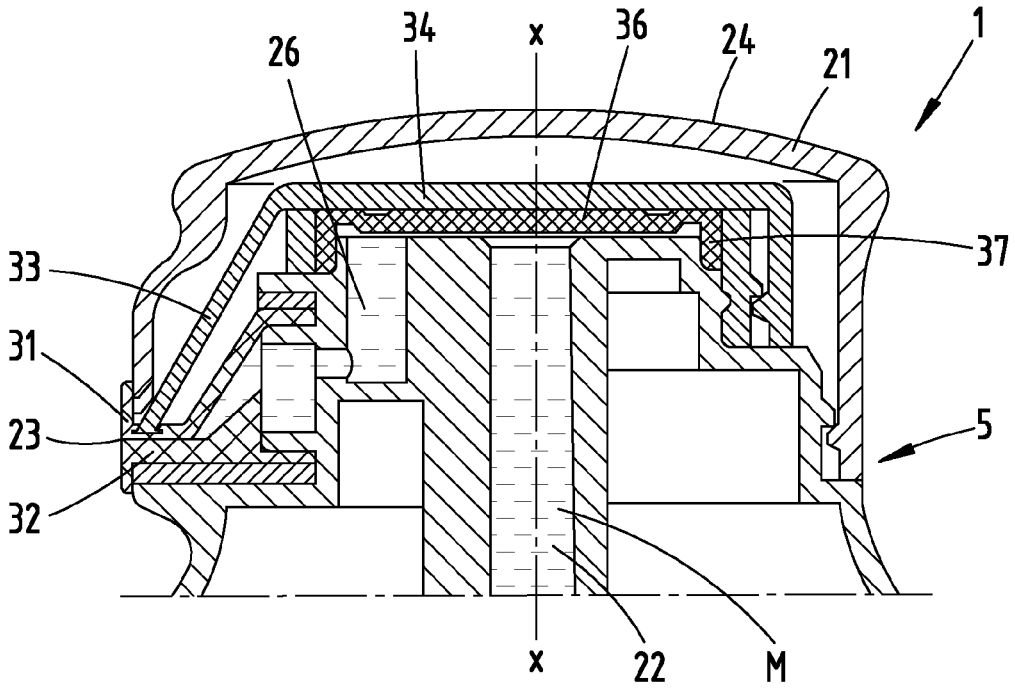
FIG. 2 shows an enlarged detail of the region II in FIG. 1.
Figure 3:
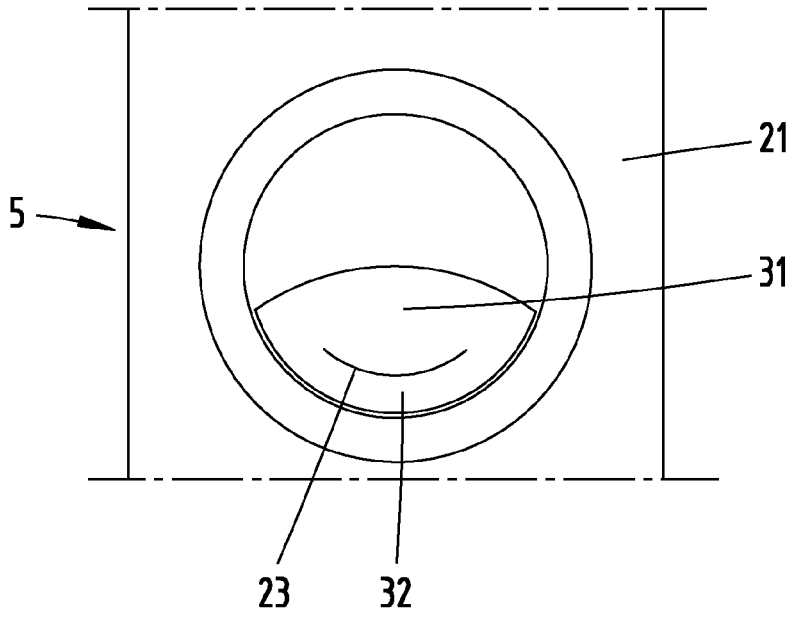
FIG. 3 shows an enlarged view of a dispensing opening of the dispenser in the direction of the arrow III.

In the closed state according to the illustrations in FIGS. 1 to 3, the lip sections 31 and 32 lie on top of one another and thereby close the dispensing opening channel 26.

The lip section 31, which in the normal upright position preferably forms the upper lip section, may be connected to a lifting part 33. The lifting part 33 may be an essentially rigid part. The end of the lifting part 33 associated with the lip section 31 may root in the material of the lip section 31, for example in such a way that the corresponding lifting part end is covered by the material of the upper lip section 31 on its underside that faces the lip section 32. In this way, a full-surface contact between the facing surfaces of the lip sections 31 and 32 can be realized in the closed position of the dispensing opening. For example, the material of the lip section 31 may be injection molded around the corresponding end of the lifting part 33.

The lifting part 33 may integrally transform into a lever part 34 as shown and optionally also consist of the same material as the lever part. This lever part may extend underneath the actuating part 21, particularly the actuating surface 24, optionally such that it intersects the longitudinal axis x and essentially overlaps the dispensing channel 22.

Furthermore, the lever part 34 may be fixed on the head part 5 opposite of the dispensing opening 23 referred to a longitudinal cross section according to FIG. 1. In this respect, a snap-on mechanism 35 is illustrated in the figures.

The lever part 34 may therefore extend in a freely protruding manner from the snap-on mechanism 35 up to the connection of the lifting part 33 to the lip section 31 over its entire length referred to the longitudinal cross section according to FIG. 1.

An elastically deformable section 36 is preferably provided underneath the lever part 34, which optionally extends from the snap-on mechanism 35 to the lifting part 33 in a dome-like manner. This elastically deformable section is fixed on the head part 5 such that it is essentially covered by the lever part 34, e.g. circumferentially along a sectional pot wall 37 in a potential rotationally symmetrical design of the head part 5.

The underside of the section 36, i.e. its side that faces away from the lever part 34, may be in contact with the material M that is held, in particular, in the dispensing channel 22. Furthermore, the underside of the section 36 may also be in contact with the material M in the dispensing opening channel 26.

According to the exemplary embodiment shown, this may be achieved by means of an end section of the dispensing opening channel 26, which faces away from the dispensing opening 23 and essentially extends in the same direction as the dispensing channel 22, namely essentially parallel to the longitudinal axis x as shown.

In the non-actuated dispenser position or in the correspondingly non-loaded position according to FIGS. 1 to 3, the elastically deformable section 36 may lie on the opening cross sections of the dispensing opening channel 26 and the dispensing channel 22, which face the underside of the section 36, or extend at a short distance between a few tenths of a millimeter and one or two or optionally three or four millimeters from said opening cross sections. In this way, a seal or barrier between the dispensing channel 22 and the dispensing opening channel 26 may be optionally realized by means of the section 36.

Figure 4:
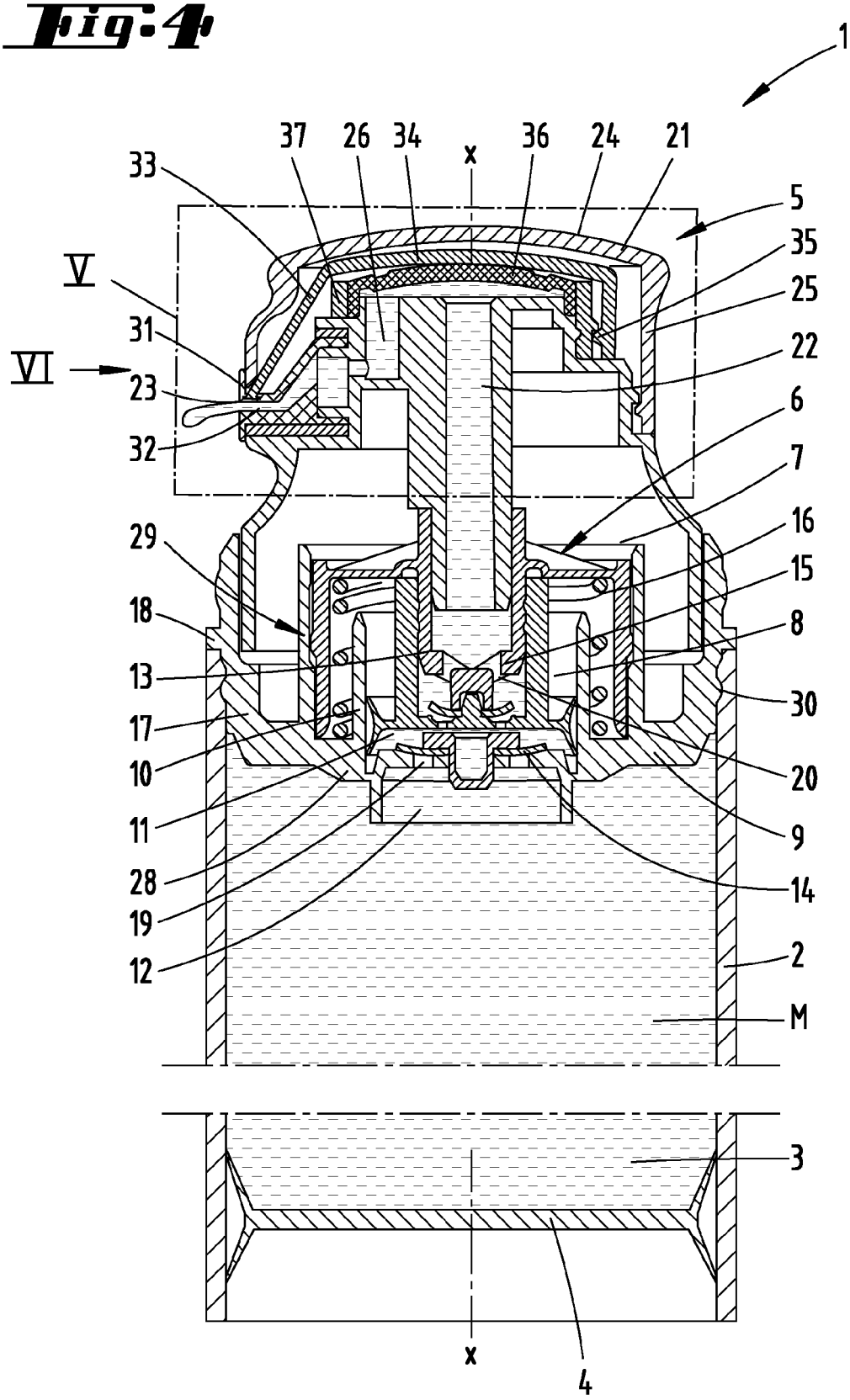
FIG. 4 shows a longitudinal section through the dispenser corresponding to FIG. 1, but concerning the dispensing position.
Figure 5:
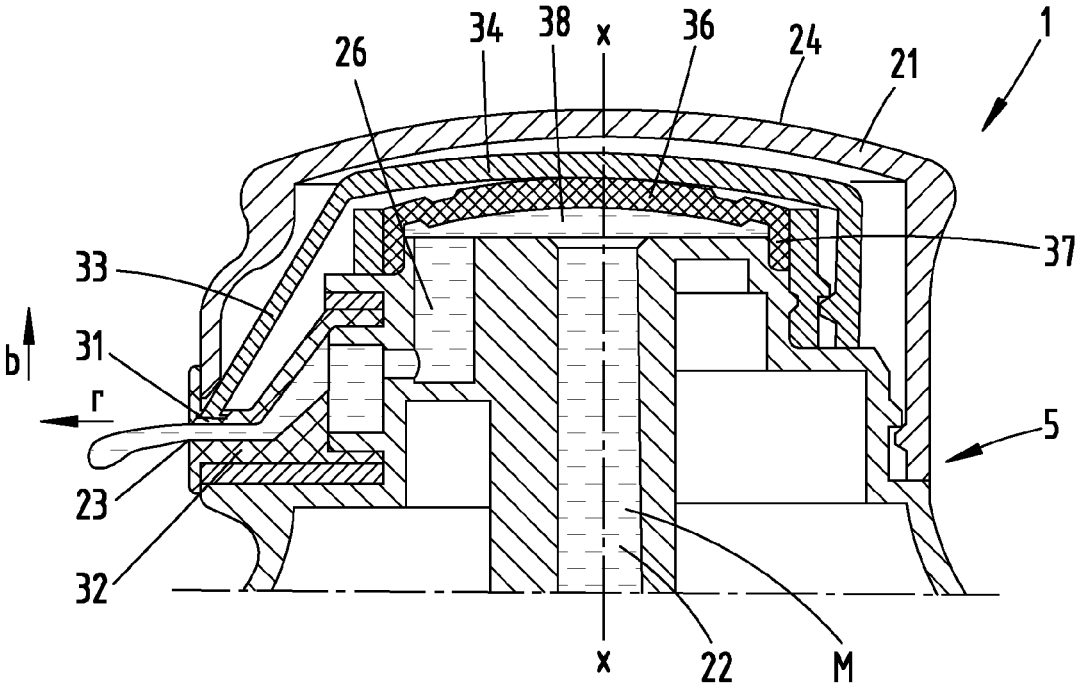
FIG. 5 shows an enlarged detail of the region V in FIG. 4.
Figure 6:
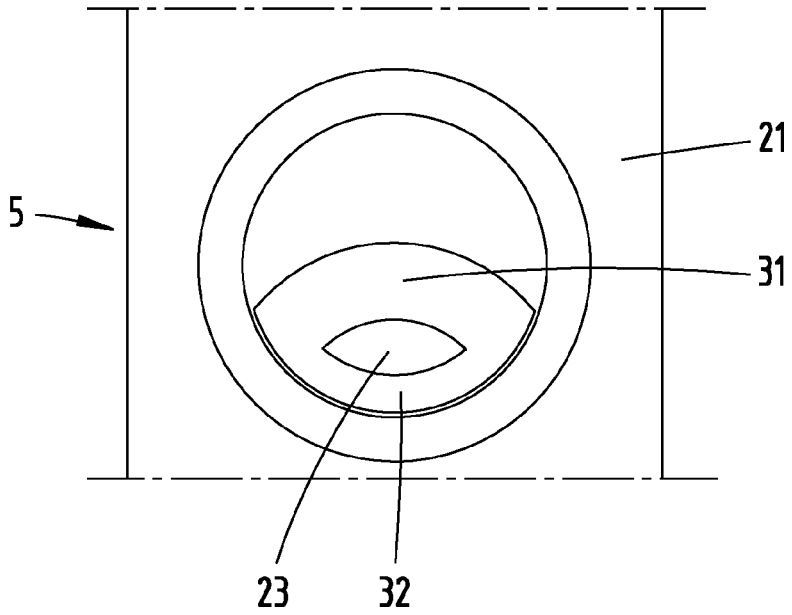
FIG. 6 shows a view of the dispensing opening in the direction of the arrow VI in FIG. 4.

A dispenser actuation according to the illustrations in FIGS. 4 to 6 and the associated lowering of the head part 5 result in a material pressure, which particularly acts against the underside of the elastically deformable section 36 via the dispensing channel 22 and leads to a deformation of the section 36 according to the illustrations in FIGS. 4 and 5.

The deformation of the elastic section 36 may lead to a dome-shaped uplift of the section 36 as shown. This initially and essentially results in a transfer channel section 38, which connects the dispensing opening 23 to the dispensing opening channel 26 underneath the section 36 and through which the material M conveyed through the dispensing channel 22 can flow into the dispensing opening channel 26 and be dispensed through the dispensing opening 23.

The bulging section 26 simultaneously acts upon the underside of the lever part 34, which can pivot about a geometric pivoting axis that extends transverse to the longitudinal axis x (perpendicular to the plane of projection of the drawings), wherein the geometric pivoting axis may lie in the region of the snap-on mechanism 35, but due to potential elastic properties of the lever part material optionally also in the region of the section of the lever part 34, which freely protrudes over the section 36.

As a result of the pivoting motion of the lever part 34, which essentially takes place in a direction of the mass flow within the dispensing channel 22 and therefore upward referred to the normal upright position, the lip section 31 is simultaneously lifted off the essentially stationary lip section 32 by means of the lifting part 33 in order to correspondingly release the dispensing opening 23 (see also FIG. 6).

In this way, an active displacement of the lip section 31 into the open position of the dispensing opening or an active assistance in the displacement of the lip section 31 into this open position is respectively achieved, wherein the loading direction b, in which the lifting part 33 acts upon the lip section 31, extends essentially transverse to the dispensing direction r of the material M in the region of the dispensing opening 23 (compare to FIG. 5).

Once the head part 5 is released again by the user after the dispensing process is completed, the retraction device 16 causes a corresponding return of the head part 5 into the starting position, wherein a lingering pressure continues to act, particularly in the dispensing channel 22 and accordingly also in the dispensing opening channel 26 leading to the dispensing opening 23, due to the elastically deformable section 36 such that the dispensing opening 23, which is optionally also returned into the closed position due to flexible properties of the lip section 31, as well as due to the return pivoting motion of the lever part 34 with its lifting part 33, does not allow a backflow of material M opposite to the dispensing direction r until the completely closed position is reached.

The preceding explanations serve for elucidating all inventions that are included in this application and respectively enhance the prior art independently with at least the following combinations of characteristics, wherein two, more or all of these combinations of characteristics may also be combined with one another, namely:

A dispenser, which is characterized in that a lip section 31 can be lifted off the other lip section 32 by means of a lifting part 33 engaging on the lip section 31 in order to open the dispensing opening 23, wherein the lifting part 33 acts upon the lip section 31 with a loading direction b that extends transverse to a dispensing direction r of the material M.

A dispenser, which is characterized in that the lifting part 33 is movable for opening the dispensing opening 23 due to a material pressure that is built up in the dispenser 1 in the course of an output of material M.

A dispenser, which is characterized in that the material pressure acts upon a lever part 34 that moves the lifting part 33.

A dispenser, which is characterized in that the lever part 34 forms part of the lifting part 33 and is realized integrally with the lifting part 33.

A dispenser, which is characterized in that the dispenser 1 has an elastically deformable section 36.

A dispenser, which is characterized in that the elastically deformable section 36 is deformable by the material pressure in order to act upon the lever part 34.

All disclosed characteristics are essential to the invention (individually, but also in combination with one another). The disclosure content of the associated/attached priority documents (copy of the priority application) is hereby fully incorporated into the disclosure of this application, namely also for the purpose of integrating characteristics of these documents into claims of the present application. The characteristics of the dependent claims also characterize independent inventive enhancements of the prior art without the characteristics of a claim to which they refer, particularly for submitting divisional applications on the basis of these claims. The invention specified in each claim may additionally comprise one or more of the characteristics that were disclosed in the preceding description and, in particular, are identified by reference symbols and/or included in the list of reference symbols. The invention also concerns design variations, in which individual characteristics cited in the preceding description are not realized, particularly as far as they are obviously dispensable for the respective intended use or can be replaced with other, identically acting technical means.

LIST OF REFERENCE NUMERALS

1 Dispenser
2 Reservoir
3 Storage chamber
4 Follower piston
5 Head part
6 Dispenser pump
7 Piston body
8 Piston
9 Pot part
10 Cylinder section
11 Pump chamber
12 Input channel
13 Output channel

14 Valve on input side
15 Valve on output side
16 Retraction device
17 Pot wall
18 Fastening projection
19 Annular gap
20 Annular gap
21 Actuating part
22 Dispensing channel
23 Dispensing opening
24 Actuating surface
25 Partial actuating wall
26 Dispensing opening region
27 Cap
28 Pot bottom
29 Limiting device
30 Snap-on projection
31 Lip section
32 Lip section
33 Lifting part
34 Lever part
35 Snap-on mechanism
36 Section
37 Sectional pot wall
38 Transfer channel section
b Loading direction
r Dispensing direction
x Longitudinal axis
M Material

The invention claimed is:

1. A dispenser (1) for dispensing liquid or pasty materials (M), which comprises a head part (5) that has a dispensing opening (23), wherein the dispensing opening (23) is formed by lip sections (31, 32) that lie directly on top of one another, wherein a lip section (31) is configured to be lifted off the other lip section (32) by means of a lifting part (33) engaging on the lip section (31) in order to open the dispensing opening (23), wherein the lifting part (33) acts upon the lip section (31) with a loading direction (b) that extends transverse to a dispensing direction (r) of the material (M), wherein the lifting part (33) is movable for opening the dispensing opening (23) due to a material pressure that is built up in the dispenser (1) in the course of an output of material (M) and wherein the material pressure acts upon a lever part (34) that moves the lifting part (33).

2. The dispenser according to claim 1, wherein the lever part (34) forms part of the lifting part (33) and is realized integrally with the lifting part (33).

3. The dispenser according claim 1, wherein the dispenser (1) has an elastically deformable section (36).

4. The dispenser according to claim 3, wherein the elastically deformable section (36) is deformable by the material pressure in order to act upon the lever part (34).

* * * * *